US005419823A

United States Patent [19]

Lazaro et al.

[11] Patent Number: 5,419,823

[45] Date of Patent: May 30, 1995

[54] ELECTROPLATING DEVICE AND PROCESS

[75] Inventors: Anton E. Lazaro, Park Ridge, Ill.; William Yates, Anaheim Hills, Calif.

[73] Assignee: Hardwood Line Manufacturing Co., Chicago, Ill.

[21] Appl. No.: 149,442

[22] Filed: Nov. 9, 1993

[51] Int. Cl.[6] ..... C25D 17/20

[52] U.S. Cl. ..... 204/201; 204/213

[58] Field of Search ..... 204/213, 201; 205/143

[56] References Cited

U.S. PATENT DOCUMENTS

| | | | |
|---|---|---|---|
| 1,916,465 | 7/1933 | Dawson | 204/213 |
| 3,397,126 | 8/1968 | Gilbert | 205/145 |
| 3,969,215 | 7/1976 | Zievers | 204/276 |
| 4,806,224 | 2/1989 | Bruun et al. | 204/222 |
| 5,006,216 | 4/1991 | Dietrich et al. | 204/257 |
| 5,139,039 | 8/1992 | Yates | 134/95.1 |

OTHER PUBLICATIONS

Electroplating Engineering Handbook, 4th Edition, Chapter 4 on Barrels, by William H. Jackson and E. Kenneth Graham, p. 458.

*Primary Examiner*—John Niebling
*Assistant Examiner*—Brendan Mee

[57] ABSTRACT

This invention relates to a process and apparatus for electroplating that has an electrolyte continually circulating through a rotating plating barrel along with its parts to be plated by having a elongated perforated tube that is positioned above the center of a barrel, whereby the barrel is provided with recirculated electrolyte by means of a pump recirculating electrolyte from a plating tank to the elongated perforations while the barrel is rotating, so that the parts are agitated and greater speed and efficiency of the plating process can be achieved.

5 Claims, 2 Drawing Sheets

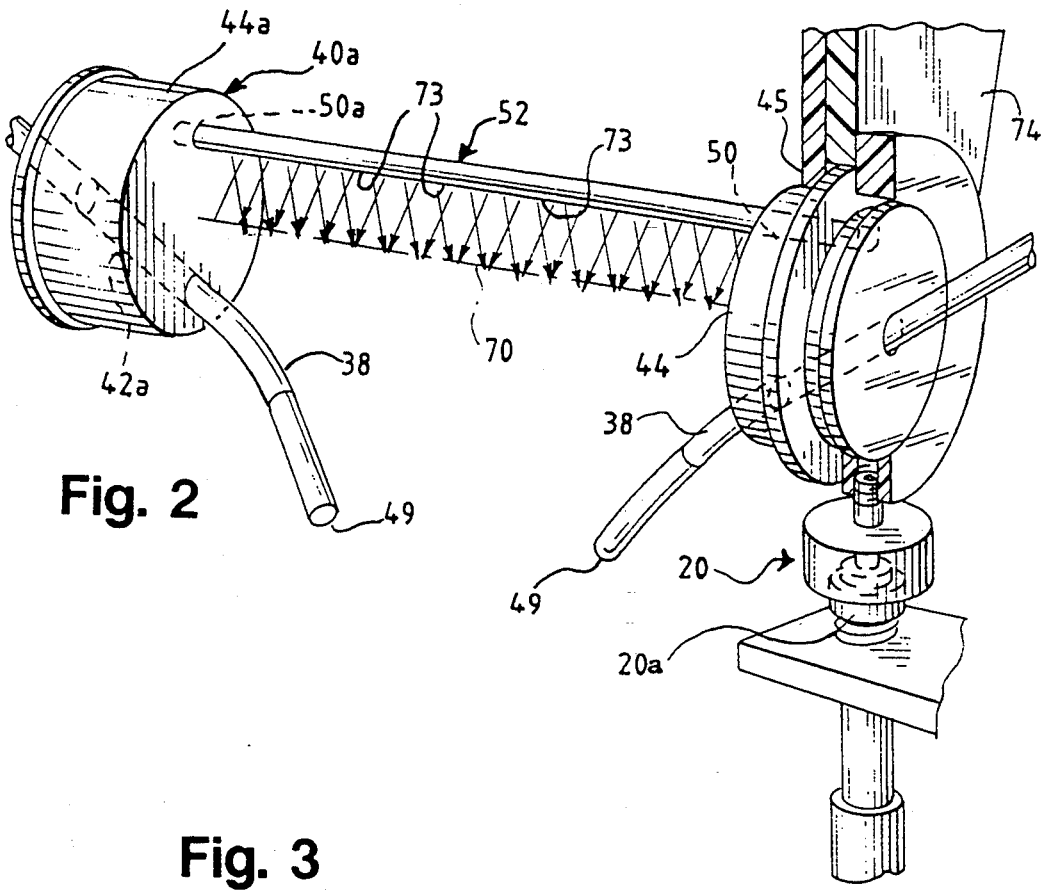
Fig. 2
Fig. 3
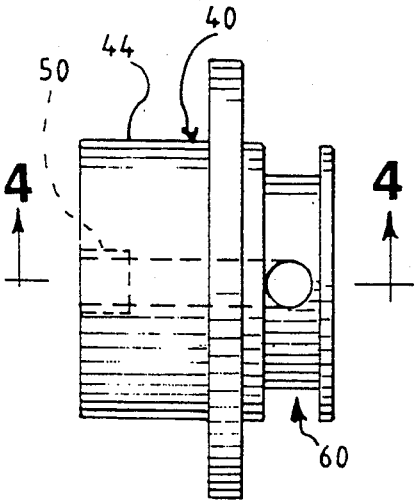
Fig. 4
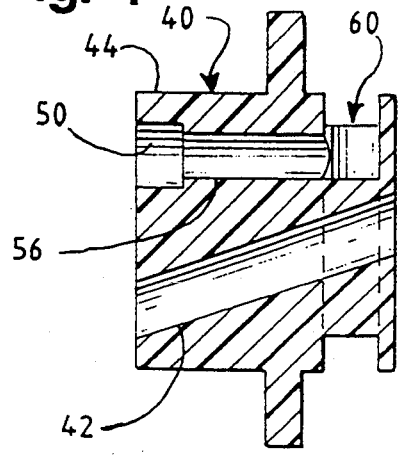

ELECTROPLATING DEVICE AND PROCESS

BACKGROUND OF INVENTION

This invention relates generally to an improved way to recycle electrolytic fluid from and to an electroplating barrel that is plating work pieces supported within the barrel. The invention employs an elongated spray tube with perforations that is connected to a pumping system continually regenerating electrolyte from the barrel and plating tank so that it can be sprayed through the perforations of the tube. This occurs while the barrel is being rotated, whereby a continual supply of electrolyte can be sprayed downward on the working parts. By having the spray tube placed above the axis of rotation of the barrel the parts can be better sprayed and covered with electrolyte, while they are being agitated by rotation of the barrel.

At the present, the systems known to us are those which are disclosed as follows:

In an electroplating engineering handbook (4th Edition) Chapter 4 on Barrels, by William H. Jackson and E. Kenneth Graham, page 458 discloses in FIG. 10 a cross-sectional view of a perforated horizontal plating barrel with electroplating solution through the cylinder into the barrel. While the solution from the tank is merely pumped from the pump back into the tank through the circulating barrel, in a circulating manner, there is no spray tube that is fixedly mounted eccentrically above the axis of rotation of the barrel to have work pieces agitated and constantly sprayed with recirculated electrolyte to obtain an efficient and speedy electroplating of parts.

As disclosed in the Patent to Yates, U.S. Pat. No. 5,139,039, issued Aug. 18, 1992, there is a suitable and efficient water rinsing means and process that utilizes a perforated spray tube that extends along across the axis of rotation; but this is only used for rinsing and does not teach or suggest the use of or how to provide a stationary spray tube mounted above the axis of rotation for the use of such system for electroplating. With an elongated perforated tube mounted eccentrically, as in our present invention, the plating is accomplished more efficiently due to better and more thorough spraying of parts since the spray has an overall larger spray from being mounted higher in the barrel to achieve speedier electroplating.

U.S. Pat. No. 1,916,465, issued to J. L. Dawson, also shows a barrel that has an axially mounted tube provided with perforations that is connected with an inlet pipe. While the inlet pipe is adapted to admit electrolyte and disperse it into the interior of the drum so as to replace the more or less spent electrolyte in the drum, there is no teaching of a perforated spray tube above the axis for spraying parts and the means to accomplish this.

SUMMARY AND OBJECTS OF THE INVENTION

Accordingly, it is an object of the present invention to provide a method and apparatus for plating a plurality of parts that are supported within a rotating plating barrel, that is positioned in a plating tank. The apparatus comprises the combination of a spray means embodied in the form of a stationary perforated elongated spray tube located within a rotating plating barrel and communicating with one end of a flexible inlet hose by means of a coupling device that has the spray tube communicating therewith through an annular hub device to enable recirculated electrolyte pumped under pressure to be forced through the stationary perforated tube, which is mounted eccentrically above the axis of the barrel for achieving an improved result in plating.

The interconnecting of the inlet hose with the annular hub device is done by means of a coupling device similar to the one described in U.S. Pat. No. 5,139,039 where there can be a pair of coupling portions such as magnetic attracting coupling plates and whereby the plates are pushed together in locking relationship, and they are sealed with appropriate seal means such as gaskets or the like. With one of the coupling portions in our device attached to and communicating with the annular hub, electrolyte can be forced under pressure to the elongated perforated tube by means of being forced up both sides of an annular portion of the annular hub and thereby enable the elongated perforated tube which is immobily mounted above the barrel axis to spray the agitated parts from a stationary position above while still enabling the barrel to rotate.

BRIEF DESCRIPTION OF THE DRAWINGS

Referring more particularly to the accompanying drawings which show a preferred embodiment of our invention for illustrative purposes only:

FIG. 2 is a pictorial view illustrating how the coupling device as connected to the plating barrel to enable electrolyte to be pumped up through an annular hub device into the eccentrically mounted stationary perforated spray tube;

FIG. 3 is a side view of the annular hub device showing the annular portion thereof that creates a passage way from the coupling members to the spray tube while the plating barrel rotates; and FIG. 4 is a sectional view of the annular device taken on a plane passing through line 4—4 and illustrating a passageway communicating with the annular portion thereof on one side and the perforated spray tube on the opposite side thereof.

DESCRIPTION

Figure 1:
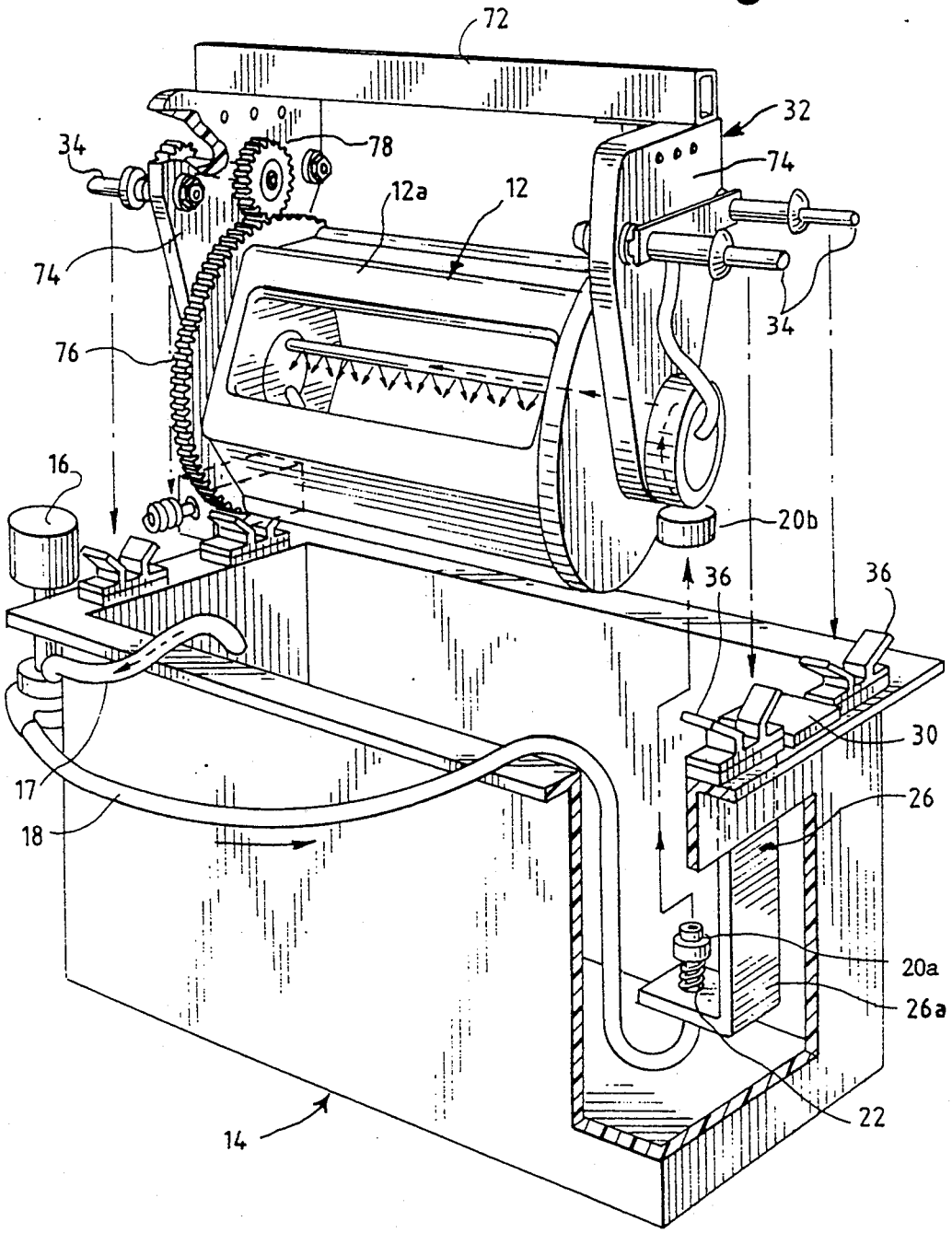
FIG. 1 is a pictorial view of a plating tank with the walls broken away to illustrate how a plating barrel can be supported therein and have a coupling device attached for purposes of enabling the pumping of recycled electrolyte from the tank back to the barrel via a perforated stationary spray tube eccentrically located above the central axis of the plating barrel.

Referring to FIG. 1, a plating barrel 12 having sidewalls **12*a* is shown above a plating tank 14 that includes a pumping system including a pump 16 which is shown attached and connected to the tank 14 by a conduit 17 which enables pumping the electrolyte out of the tank 14 and recirculating it through the recirculating conduit portion 18 after it has been pumped through conduit 17. The recirculating conduit 18 which is connected to a coupling device 20 through a lower spring-biased coupling member 20*a* that has a spring disposed and sized to fit around the end 22 of recirculating conduit 18. The lower spring-biased coupling member 20*a* is associated with conduit 18 on one side and is supported by a bottom portion 26*a* of the bracket 26 which is shown as preferably being "z" shaped, and urging the coupling member 20*a* upward when the spring is compressed and resting on the bottom portion 26*a* of the bracket 26**.

As seen from FIGS. 3 and 4 the coupling member **20*a* is flexible and movable. The coupling device 20 also has an upper barrel coupling member 20b that is shaped to receive the lower spring biased coupling member 20a when the plating barrel 12 is lowered down into the tank. The flexible and movable coupling member 20a enables it to be put in registry with the coupling member 20b of the coupling device 20 which can have gaskets along with magnets for creating a seal in a conventional manner when the coupling members 20a, 20b are engaged. The lower spring biased coupling member 20a which is shown in FIGS. 1 and 2 is secured in engagement by the force of spring 23 being pressed down against the bracket 26 at the bottom portion 26a thereof. As was noted in U.S. Pat. No. 5,139,029, coupling members of this sort can be magnetic and the coupling devices can be held together by magnetism and sealed by seals as well as gaskets pressed into engagement by means of the spring exerting a force equal and opposite to the weight and force of the barrel, as illustrated in FIGS. 2 and 3**.

As seen from FIG. 1, the bottom portion 26a of the "z" shaped bracket extends upward through an intermediate portion 26b to the upper portion 26c, which is removably associated with the tank 14 at the opening 30 formed by the cradle contact means 36.

Thus, once the barrel 12 is lowered so that the coupling members 20a and 20b are pushed together with a force that maintains a positive seal between them to lock the coupling device 20, the recirculating conduit 18 is in communication with the plating barrel 12.

The plating barrel 12 is constructed very similar to existing ones so that the supporting frame structure 32 is provided with the support lugs or pins 34 which rest on the cradle members 36. These lugs 34 also make up part of the electrical system necessary to provide electric power for electroplating. Two cables 38 are connected to each set of lugs 34 and enter the annular hub means 40, and the other hubs means 40a by means of the annular passage ways 42, 42a which are shown in FIGS. 2 and 4. The annular hub means 40 is shown as having a bearing means 44 containing the journal portion 46 of the supporting legs 16 as shown in FIGS. 4 and 5. The cables or danglers 38 pass through the passageways 42 and extend into the barrel to define a pair of oppositely disposed electrodes 49 at the end of the danglers 38. It should be noted that the hub means 40a is the same as the annular hub means 40, except that it does not have the annular portion, or the liquid passageways of the annular hub means 40. As seen from FIG. 2, the hub means 40, 40a, are oppositely disposed and are both stationary to one another to form the center around which the plating barrel 12 rotates.

The plating barrel 12 is adapted to receive a spray means such as the perforated elongated spray tube 52 which is shown mounted within the walls of the barrel and attached to the barrel hub means 40, 40a by cylindrical shaped receiving means 50, 50a. As seen from the drawings the annular hub means 40 has the annular portion 60 that communicates with the tube 52 by means of the passageway 56. As seen from the drawings the passageway 56 communicates with the coupling device 20 when the spring biased coupling means 20a and the barrel coupling means 20b are engaged in their locked position as shown in FIG. 2.

Therefore, when the electroplating barrel 12 has been lowered to the position where the coupling device 20 is locked, electrolyte is drawn from the tank 14 by the pump 16 and finally through the recirculating conduit 18 which communicates with the coupling device 20 and annular portion 60, whereby the recirculated electrolyte is disbursed to the barrel and the parts that are in the barrel by being sprayed by means of the apertures 73 in the elongated spray tube 52.

The barrel 12 is rotatably mounted on the journaling portions 44, 44a of the hubs 40, 40a which are located in the depending side by members 16 to enable the barrel 12 to rotate about its central axis 70 while the elongated spray tube 52 which is mounted upward of the axis remains stationary since it is mounted at each end in the cylindrical cavity tube holding bears 50, 50a as seen in FIG. 2. The elongated spray tube 52 is mounted so that the apertures 73 therein are directed in a relatively downward direction to guide a spray or stream of electrolyte that enhances the ability of the parts to be plated by causing the electrolyte to contact the parts more efficiently when the parts are being agitated. Since the spray tube 52 is located above the central axis 70, parts can be piled higher in the barrel and greater dielectric dispersion and electrical contact can be made with the parts to enhance and speed up the plating process. The side walls 12a of the barrel are also perforated to allow free flow of the processing electrolyte so that the largest number of surfaces of the parts are sprayed.

The frame structure 32 in further including a substantially horizontal cross beam 72 that interconnects depending side members 74 as shown in FIG. 1 of the drawings, provides a means of transporting the barrel up and down or from tank to tank as is common in plating. The barrel 12 has two opposite ends 54 with one of them fixedly associated with a gear 76 that is driven by a pinion gear 78, which can be in turn associated with a motor to cause the plating barrel 16 to rotate.

As stated earlier, spraying of the dielectric creates more of a thorough contact with the parts. The top parts in the barrel that are agitated, but not submerged can be sprayed and the electrolyte can be recirculated as beforementioned. With the plating barrel 12 mounted so that it is removably positioned in the cradles 36 of the tank structure 14, the barrel is selectively immersed in dielectric in the tank and the spray means 52 which is located above the central axis 70 of the plating barrel causes the parts to be more thoroughly mixed with the dielectric to create improved plating action. By recirculating the dielectric with the pump 16 and causing the dielectric to be forced through the annular portion, we not only are able to locate the tube above the central axis, but also we are able to prevent the interruption of fluid by means of clogging on one side of the annular opening, since both sides of the annular portion would have to be clogged in order to preclude the dielectric from being recirculated. This advantage together with providing a unique and elegant arrangement of the stationary spray tube above the central axis enhances the performance of the barrel by making it more efficient.

It may thus be seen that the objects of the present invention set forth herein as well as those made apparent from the foregoing description, are efficiently obtained. While preferred embodiments of the invention have been set forth for purposes of disclosure, modification of disclosed embodiments of the invention as well as other embodiments thereof may occur to those skilled in the art. Accordingly, the appended claims are intended to cover all embodiments which do not depart from the spirit and scope of the invention.

What we claim is:

1. An apparatus for providing a spray of a recirculated electrolyte fluid from a source onto a plurality of parts that are disposed within a rotatable plating barrel that agitates the parts by its rotation comprising:

a tank adapted to receive and cooperate with the plating barrel in removable engagement;

spray means extending within said plating barrel for spraying the parts with electrolyte, said spray means mounted eccentrically with respect to a central axis of said plating barrel a predetermined distance above the central axis and said parts; and at least one stationary hub means having a portion in selective communication with said fluid source and having journalling means for enabling said plating barrel to rotate while said spray means is mounted on said hub means and remains stationary, said spray means being in communication with the source of the fluid for directing the fluid under pressure from the source to said spray means;

whereby enhanced and more efficient electroplating of parts can be accomplished.

2. The apparatus, as defined in claim 1, wherein said spray means comprises a spray means mounted at at least one end of said barrel and having a plurality of apertures to provide a spray on said parts.

3. The apparatus as defined in claim 1, wherein said hub means has an annular portion in selective communication with said fluid source and formed to communicate with said spray means when connected in communication therewith and enable said spray to be fed from opposite directions and thereby increase the amount of pressure on the liquid being forced through said annular portion.

4. The apparatus as defined in claim 1, wherein a coupling device removably associates said hub means of said barrel and the fluid source, said coupling device having a barrel coupling member associated with said barrel and in communication with said hub means, and another coupling member associated with said fluid source, said barrel coupling member being in communication with said fluid source and said hub members, whereby said spray means within said barrel can be connected with said source of recirculated fluid when said barrel is positioned into proximity with said other coupling member to enable said coupling device to be locked into engagement.

5. The apparatus, as defined in claim 2 wherein said spray means is a spray tube that is mounted to at least one end of said barrel.

* * * * *